US009951544B2

(12) United States Patent
Loukeris

(10) Patent No.: US 9,951,544 B2
(45) Date of Patent: Apr. 24, 2018

(54) CYLINDER LOCK

(71) Applicant: ASSA ABLOY Australia Pty Limited, Oakleigh South (AU)

(72) Inventor: Peter Loukeris, Oakleigh South (AU)

(73) Assignee: ASSA ABLOY AUSTRALIA PTY LTD, Oakleigh (AU)

( * ) Notice: Subject to any disclaimer, the term of this patent is extended or adjusted under 35 U.S.C. 154(b) by 36 days.

(21) Appl. No.: 14/887,833

(22) Filed: Oct. 20, 2015

(65) Prior Publication Data

US 2016/0108642 A1 Apr. 21, 2016

(30) Foreign Application Priority Data

Oct. 20, 2014 (AU) ..... 2014904183

(51) Int. Cl.

| | |
|---|---|
| ***E05B 27/00*** | (2006.01) |
| ***E05B 15/00*** | (2006.01) |
| ***E05B 17/04*** | (2006.01) |
| *E05B 63/00* | (2006.01) |
| *E05B 63/04* | (2006.01) |
| *E05B 9/04* | (2006.01) |

(52) U.S. Cl.

CPC ..... *E05B 27/0007* (2013.01); *E05B 15/004* (2013.01); *E05B 17/04* (2013.01); *E05B 17/047* (2013.01); *E05B 63/0013* (2013.01); *E05B 63/04* (2013.01); *E05B 2009/046* (2013.01)

(58) Field of Classification Search

CPC .... E05B 27/0007; E05B 15/004; E05B 17/04; E05B 17/047; E05B 63/0013; E05B 63/04; E05B 2009/046; E05B 63/0056; E05B 2047/0024; E05B 9/084; E05B 9/10; E05B 17/0004; E05B 63/08; Y10T 292/0983; Y10T 70/5341; Y10T 70/5354; Y10T 70/5363; Y10T 70/7712; Y10S 70/42; E05C 9/026

USPC ..... 70/379 R, 380, 379 A, 134, 139

See application file for complete search history.

(56) References Cited

U.S. PATENT DOCUMENTS

| | | | | | |
|---|---|---|---|---|---|
| 2,276,655 | A * | 3/1942 | Jacobi | E05B 17/04 | 70/380 |
| 2,620,648 | A * | 12/1952 | Quigley | E05B 17/04 | 70/134 |
| 2,912,846 | A * | 11/1959 | Schweitzer | E05B 57/00 | 292/224 |
| 2,998,274 | A * | 8/1961 | Russell | E05B 63/18 | 292/169.17 |
| 3,293,892 | A * | 12/1966 | Falk | E05B 9/045 | 70/358 |
| 3,390,910 | A * | 7/1968 | Kuchler | E05B 55/005 | 292/169.15 |
| 3,954,292 | A * | 5/1976 | Johnson | E05C 1/16 | 292/169.17 |
| 4,011,741 | A * | 3/1977 | Nolin | E05B 59/00 | 292/34 |

(Continued)

*Primary Examiner* — Suzanne L Barrett

(74) *Attorney, Agent, or Firm* — DeLio, Peterson & Curcio, LLC; Peter W. Peterson

(57) ABSTRACT

A cylinder lock 1 for use with a lock assembly 10. More specifically the cylinder lock is of the kind including a cam 5 rotatable from one side by a hand turn means 4, and an opposed side by a key controlled barrel 3. The configuration of the first side of the cam 5 so as to inhibit the interaction with the barrel 3 provides a useful result.

20 Claims, 5 Drawing Sheets

(56) References Cited

U.S. PATENT DOCUMENTS

| | | | | | |
|---|---|---|---|---|---|
| 4,195,504 | A * | 4/1980 | Foshee | E05B 59/00 | 70/369 |
| 4,228,669 | A * | 10/1980 | Bischoff | E05B 9/105 | 70/134 |
| 4,679,418 | A * | 7/1987 | Allen | E05B 17/042 | 70/134 |
| 5,044,183 | A * | 9/1991 | Neyret | E05B 17/04 | 70/223 |
| 5,666,835 | A * | 9/1997 | Keller | E05B 9/045 | 70/396 |
| 7,428,836 | B2 * | 9/2008 | Yang | E05B 9/048 | 70/369 |
| 8,347,678 | B2 * | 1/2013 | Chong | E05B 27/005 | 70/340 |
| 2004/0025548 | A1 * | 2/2004 | Eller | E05B 9/08 | 70/224 |
| 2005/0229656 | A1 * | 10/2005 | Brown | E05B 63/0034 | 70/107 |
| 2012/0210758 | A1 * | 8/2012 | Dolev | E05B 9/042 | 70/496 |
| 2016/0040454 | A1 * | 2/2016 | Viviano | E05B 33/00 | 70/129 |

* cited by examiner

CYLINDER LOCK

TECHNICAL FIELD

This invention relates to a cylinder lock for use with a lock assembly. More specifically the cylinder lock is of the kind including a cam rotatable from one side by a hand turn means, and an opposed side by a key controlled barrel. The cylinder lock has a particular application for use with mortice lock having a short backset, and it will be convenient to hereinafter describe the invention with reference to this application. It should be appreciated that the invention may have other applications.

BACKGROUND OF INVENTION

A mortice lock assembly is one form of lock assembly that is located in a mortice cavity formed in a side edge of a door. Where the door edge has limited depth to form the mortice cavity, a mortice lock assembly with a housing having a short depth (referred to as a short backset mortice lock assembly) may be the only option for that can fit in the cavity. However this type of housing will have less space within which the elements of the lock assembly can operate than a standard backset lock assembly.

The elements of the mortice lock will generally include a bolt moveable relative to the housing, an actuator which is operable to move the bolt and a lock means for controlling operation of the actuator and/or movement of the bolt. The lock means may include a detent that slides relative to the housing for adjustment of the condition of the lock between a locked condition and a release condition. Adjustment of the detent can be as a result of operation the cylinder lock, or more specifically rotation of the cam of a cylinder lock.

The door may be installed for left hand opening or right hand opening depending upon the configuration of the entrance. The mortice lock will generally have a preferred orientation regardless of whether the door is left hand opening or right hand opening. This may include orienting of the cylinder lock always above, or always below the actuator handle. Where the mortice lock includes a hook bolt, the preferred orientation may be so that the hook bolt always swings up to a latch position. Furthermore it is generally preferred that the orientation allow for any pin tumblers in the cylinder lock to be located above the barrel. This allows the springs of the cylinder lock to work in conjunction with gravity on the pin tumblers rather than against gravity. Accordingly it is preferred to pivot the mortice lock assembly about a vertical axis when adjusting for installation between either a right hand opening or a left hand opening door.

A reference herein to a patent document or other matter which is given as prior art is not to be taken as an admission that that document or matter was, in Australia, known or that the information it contains was part of the common general knowledge as at the priority date of any of the claims.

SUMMARY OF THE INVENTION

According to this invention there is provided a cylinder lock for use with a lock assembly, the cylinder lock includes a housing, a barrel including a keyway for accommodating a key, the barrel being rotatable relative to the housing about an axis by rotation of said key inserted in the keyway, a hand turn means being rotatable about the axis relative to the housing, a cam including a body and an arm extending radially from the body for interaction with the lock assembly being rotatable relative to the housing about the axis from a first position by rotation of either the barrel or hand turn means, the cam being positioned between the barrel and the hand turn means, the barrel and the cam being configured for loss motion there between while the hand turn means and the cam being configured to act directly there between. This arrangement makes the cylinder lock suitable for use with lock assemblies where limited rotation of the cam is required, while still permitting the key to be removed from the keyway.

It is preferred that the hand turn means and the barrel are rotatable to rotate the cam in both a clockwise direction and an anti-clockwise direction from the first position. This facilitates making the cylinder lock suitable for use with a lock assembly installed in a door for either left hand opening door or right hand opening.

It is preferred that the hand turn means can rotate the cam through no more than 135° from the first position. More specifically it is preferred that the hand turn means can rotate the cam through more than 135° when the key is inserted in the keyway, and is limited to rotating the cam through no more than 135° from the first position when the key is not inserted in the keyway. This enhances the suitability of the cylinder lock for use with a lock assembly that has limited room within which the cam can move.

The hand turn means may include a rotatable member having a distal end and the cam body has a first side, both the distal end and the first side being configured to mate for driving engagement so that rotation of the rotatable member directly drives the cam. The distal end of the rotatable member and the first side of the cam may be configured in any suitable arrangement to achieve this result. One suitable arrangement may be that the distal end of the rotatable member includes a protrusion at its distal end and the first side of the cam body includes a recess to accommodate the protrusion. The protrusion and the recess may take any shape, and one preferred arrangement includes the protrusion being wedge shaped and said recess is similarly wedge shaped to receive the wedge shaped protrusion in a tight fit.

It is preferred that the rotatable member include some form hand engageable portion, and one preferred form is a blade portion at a proximal end. When the cylinder lock is being assembled it is preferred that the blade portion aligns with the cam arm when the cam is in the first position, and the protrusion at the distal end of the rotatable member to locate in the recess of the first side of the cam body. This arrangement simplifies the process of assembling the cylinder lock.

It is preferred that the cam be configured so as to facilitate the correct assembly of the cylinder lock. This may include the first side of the cam being configured to inhibit mating for driving engagement with the barrel when the cylinder lock is being assembled. One preferred configuration may include the first side having a centrally located stem. This stem would abut against the distal end of the barrel preventing the protrusion seating in the recess. It is further preferred that the distal end of the rotatable member includes an aperture that is centrally located to accommodate the stem of the first side of the cam when the lock is assembled.

It is preferred that the barrel has a distal end and the cam body has a second side, both the distal end of the barrel and the second side of the cam body being configured to mate for driving engagement there between while permitting loss motion of rotation between the barrel and the cam. This allows the cam to be rotated from the first position to operate the mortice lock, leaving the cam arm in the rotated position, while the barrel is returned to the vertical position so that the key may be extracted. The level of loss motion may be any suitable amount and in one embodiment the barrel and cam are configured for up to 135° of loss motion of rotation of the cam from the first position in either the clockwise direction or the anti-clockwise direction. The barrel and the cam may be configured in any suitable manner to achieve this loss motion and one arrangement may include the distal end of the barrel having a protrusion and the second side of the cam body having a recess to accommodate said protrusion, said recess and said protrusion being shaped to limit said loss motion of rotation. The recess may take any suitable form with one optional form being that the recess on the second side is defined by a radially extending wall which is engaged by said protrusion on the barrel when the cam is rotated by the barrel. The size of the protrusion on the barrel may vary to adjust the level of loss motion required and in one preferred embodiment the protrusion of the barrel occupies an arc of no more than 30°.

The preferred cylinder lock is of the kind that the housing includes a first bore to accommodate the barrel and a second bore to accommodate the hand turn means, the first bore being spaced from the second bore by a void to accommodate the cam. Furthermore the housing includes a pin chamber portion having a plurality of tubes extending radially from the first bore and the second bore for accommodating pin tumblers. It is still further preferred that the tubes associated with the first bore accommodate pin tumblers and at least one of the tubes associated with the second bore accommodates a detent for interaction with the rotatable member. The cylinder lock is not limited to use with pin tumblers and may incorporate any suitable form of tumble such as disc or wafer tumblers.

It will be convenient to hereinafter describe the invention in greater detail by reference to the attached illustrations of a preferred embodiment of the cylinder lock according to the invention. The particularity of the illustrations, and the accompanying detailed description is not to be understood as superseding the generality of the preceding definition of the invention according to each of its aspects.

BRIEF DESCRIPTION OF DRAWINGS

In order that the invention may be more fully understood, some embodiments will now be described with reference to the figures in which.

DETAILED DESCRIPTION

Figure 1:
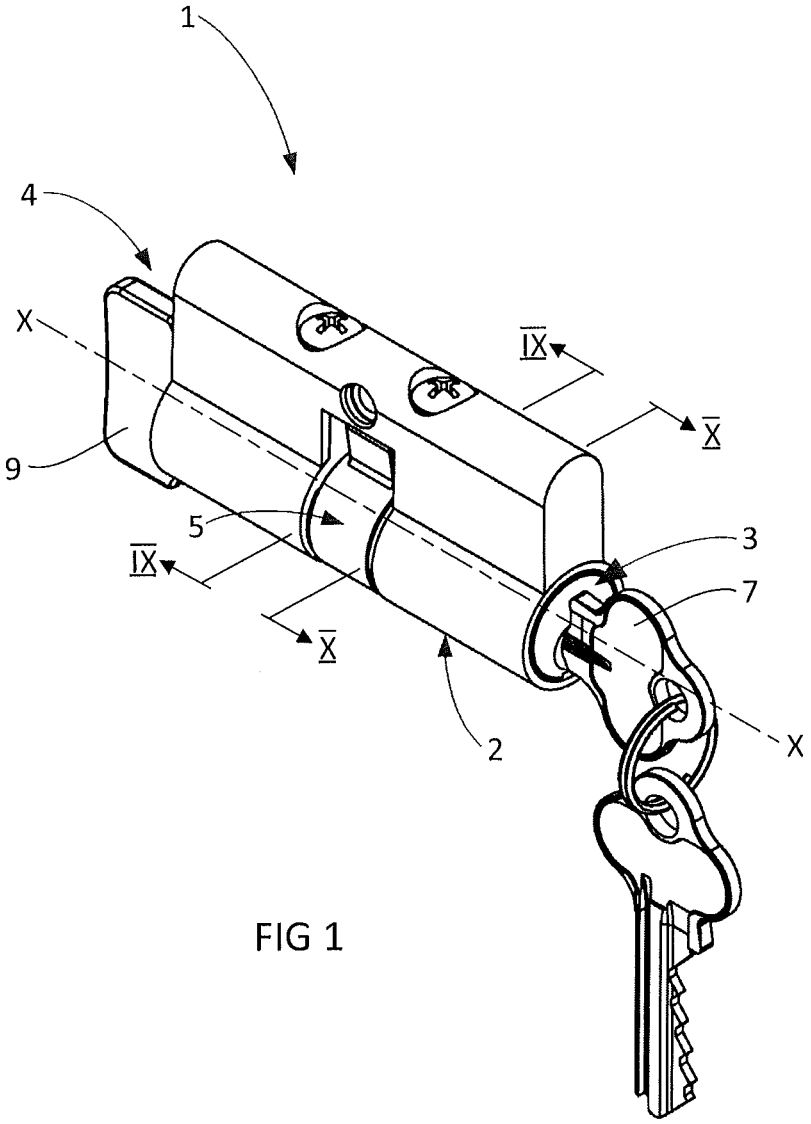
FIG. 1 is an isometric view of a preferred embodiment of the cylinder lock according to the invention.

Referring now to FIG. 1 which illustrates a preferred embodiment of a cylinder lock according to the invention including in summary a housing 2, a barrel 3 operable from an outer side of the housing 2 and a hand turn means 4 operable from an inner side of the housing. Both the hand turn means 4 and the barrel 3 are rotatable about an axis XX so as to rotate a cam 5 about the axis XX. The barrel 3 illustrated includes a keyway 6 (see FIG. 4) to receive a suitable key 7 therein for interaction with tumblers 8 (see FIG. 4) in a manner that will be understood by those skilled in the art.

The hand turn means 4 includes a portion 9 for gripping by hand so as to facilitate rotation. Clearly the shape of the portion 9 may vary from the blade illustrated so long as it allows it to be gripped by the hand and facilitates rotation about the axis XX.

Figure 2:
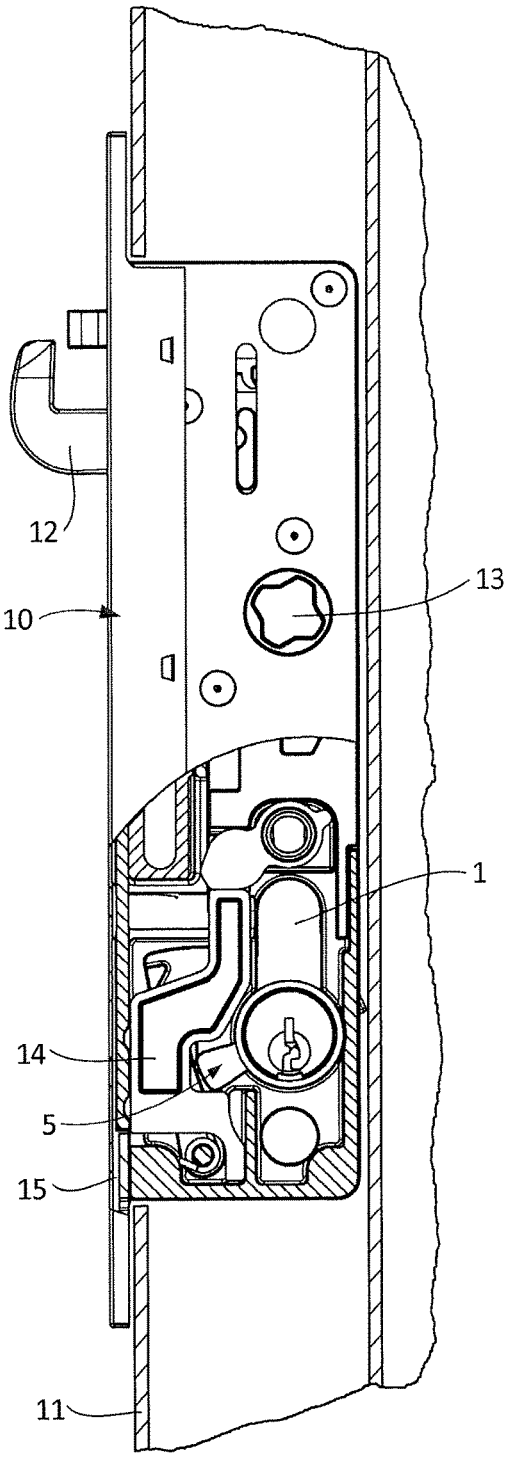
FIG. 2 is an outer side elevation view of a preferred embodiment of a mortice lock installed in a left edge of a door with the cylinder lock from FIG. 1 installed.

Referring now to FIG. 2 which illustrates an example of a short back set mortice lock assembly 10 with a cylinder lock 1, viewed from an outer side of the door 11 installed. The cylinder lock 1 is not limited for use with this form of lock 10 only, and may be used with other forms of lock. The mortice lock 10 is located in a mortice cavity which is formed in a side edge of the door 11. The mortice lock assembly 10 illustrated includes a hook bolt 12 which can be pivoted between an extended position (as shown) and a retracted position by rotation of a hub actuator 13. The hub 13 can be rotated by a handle (not shown) located on an inner and outer side of the door 11.

The mortice lock assembly 10 illustrated also includes a detent slide 14 which is raised or lowered relative to the mortice lock assembly housing 15 by rotation of the cam 5. It should be appreciated that the cam 5 has been rotated from substantially vertical orientation as illustrated in FIG. 1 (hereinafter referred to as the first position) anticlockwise through 135°. The manner in which the cam 5 is rotated will be describe in greater detail with reference to later drawings. It should be noted from FIGS. 2 and 3 that the cam 5 has limited room within the mortice lock assembly housing.

Figure 3:
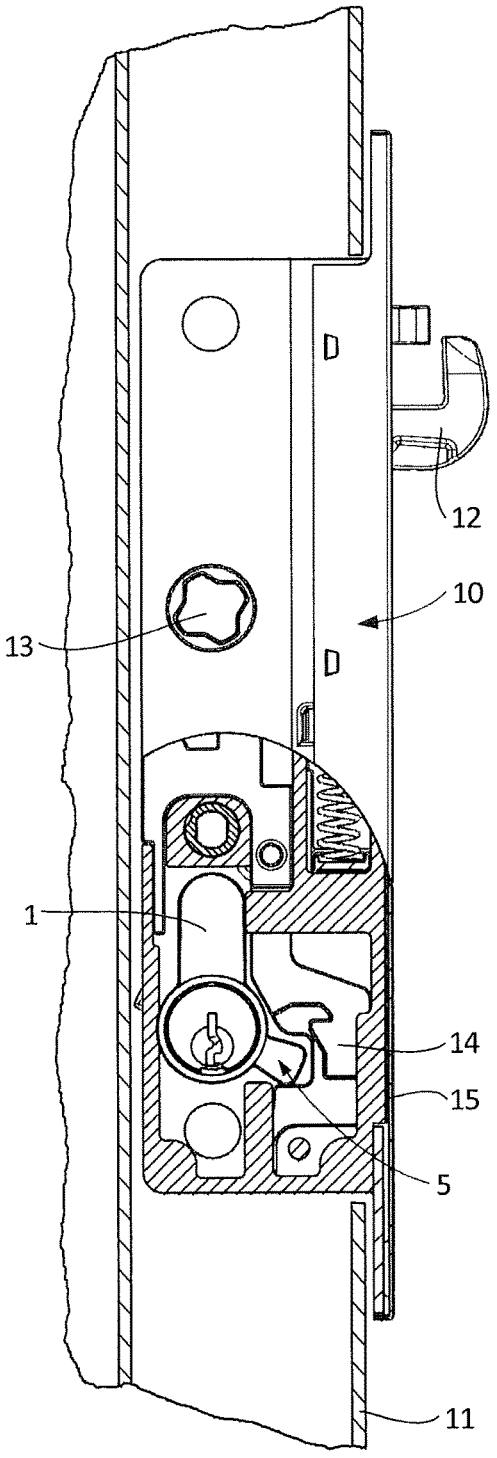
FIG. 3 is an outer side elevation view of the mortice lock from FIG. 2 installed at a right edge of the door.

FIG. 3 illustrates the same mortice lock assembly 10 with the housing 15 orientated relative to the door 11 so that the hook bolt 12 extends out from a right edge of the door 11. With the mortice lock assembly 10 in this orientation and the hand turn means 4 of the cylinder lock 1 again on the inner side of the door, the cam 5 must be rotated clockwise from the first position through the 135° to adjust the position of the detent 14.

Figure 4:
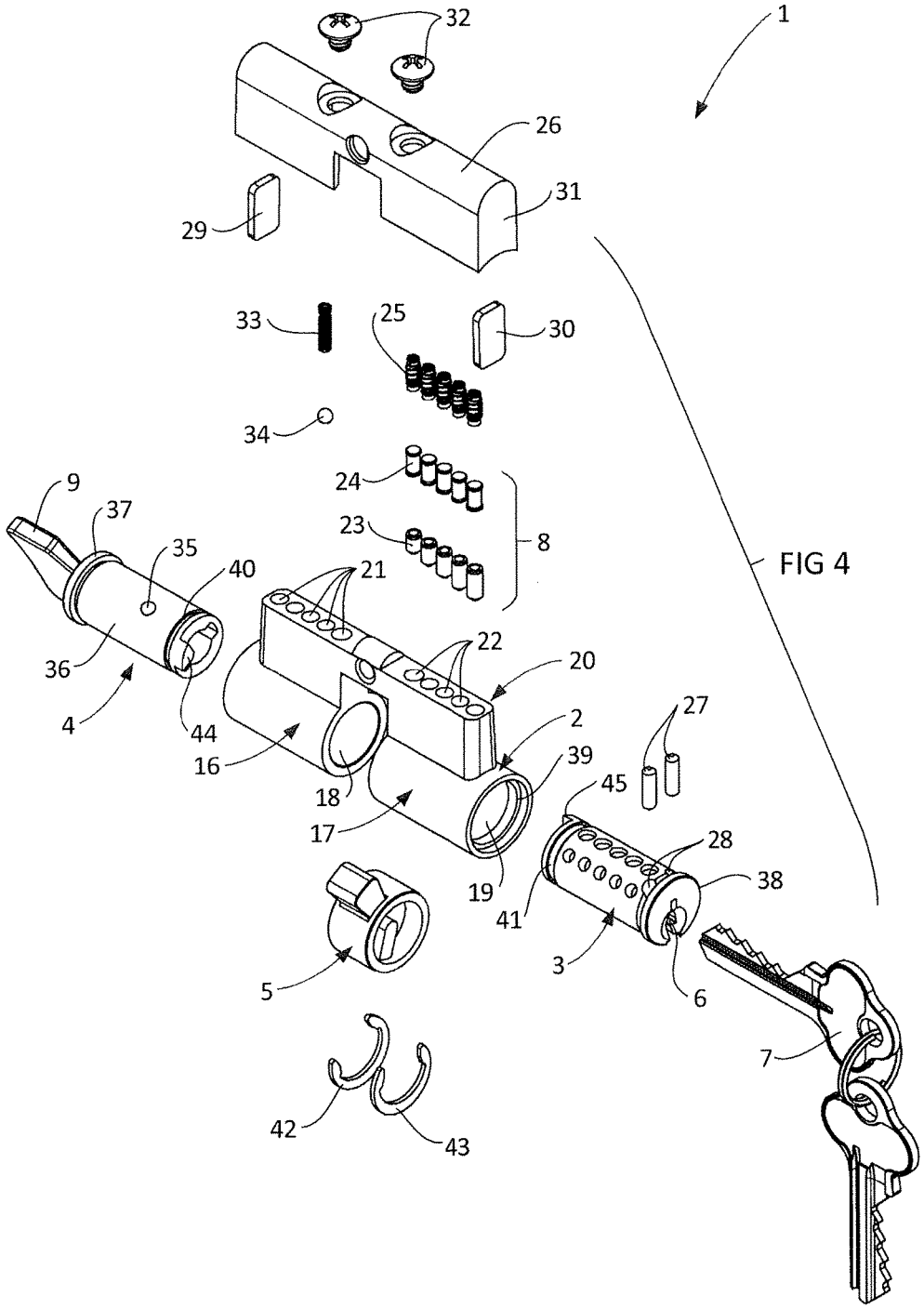
FIG. 4 is an exploded view of the cylinder lock from FIG. 1.

Referring now to FIG. 4 which illustrates the cylinder lock 1 in an exploded view. The housing 2 illustrated includes an inner cylindrical portion 16 and an outer cylindrical portion 17 having an inner bore 18 and an outer bore 19, to accommodate the hand turn means 4 and barrel 3 respectively. The inner cylindrical portion 16 and outer cylindrical portion 17 are joined by a pin chamber portion 20. The pin chamber portion 20 includes a plurality of inner tubes 21, and outer tubes 22, which are both capable of accommodating the pin tumblers 8. It should be noted that the pin tumblers 8 are configured to interact with the barrel 3 which in FIG. 4 is illustrated and associated with the outer cylindrical portion 17. However the housing 6 is designed to accommodate a barrel 3 in the inner side 18 also which has the advantage of reducing inventory for the cylinder lock manufacturer. This form of cylinder lock 1 having twin barrels 3 does not form part of the invention.

The tumblers 8 illustrated in FIG. 4 include five bottom pins 23, and five top pins 24 which are each individually urged towards the barrel 3 by five coil springs 25. The tumblers 8 are retained within the outer tubes 22 by locating a cap 26 over the top of the pin chamber portion 20, and securing the cap 26 to the pin chamber portion by the pair of screw fasteners 32.

FIG. 4 also illustrates a pair of bars 27 which locate in radially extending bores 28 formed adjacent to proximal end of the barrel 3. An inner plate 29 and outer plate 30 are also provided positioned between the pin chamber portion 20 and an inner wall (obscured) and outer wall 31 of the cap 26 respectively. The inner plate 29, outer plate 30 and bars 27 are provided to increase resistance of the cylinder lock to attack by a drill drilling out the tumbler 8. The inner plate 29, outer plate 30 and bars 27 may be formed from a toughened metal, tougher than the metal forming the barrel 3 or housing 2 to facilitate this function.

FIG. 4 also illustrates a coil spring 33 and ball detent 34 for location in one of the inner tubes 21 which aligns with a recess 35. The ball detent 34 interacts with the recess 35 formed in an annular surface of the rotatable member 36 when the blade 9 is in a vertical orientation.

FIG. 4 illustrates both the rotatable member 36 and the barrel 3 having a flange 37, 38 at its proximal end for locating against a shoulder 39 formed at the proximal end of each of inner cylindrical portion (obscured) and outer cylindrical portion 39. Both the rotatable member 36 and the barrel 3 include an annular groove 40, 41 formed adjacent a distal end thereof for accommodating a circlip 42, 43 when the rotatable member 36 and barrel 3 are located within the respective inner cylindrical portion 18 and outer cylindrical portion 19.

The hand turn means 4 and the barrel 3, along with the cam 5, are configured for interaction there between. More specifically, the barrel 3 and the cam 5 are configured so as to allow loss motion there between whilst the hand turn means 4 and the cam 5 are configured to act directly there between. FIG. 4 illustrates a preferred embodiment of this arrangement whereby a distal end of the rotatable member 36 and a distal end of the barrel 3 each include a protrusion 44, 45 which interacts with the cam 5.

Figure 5:
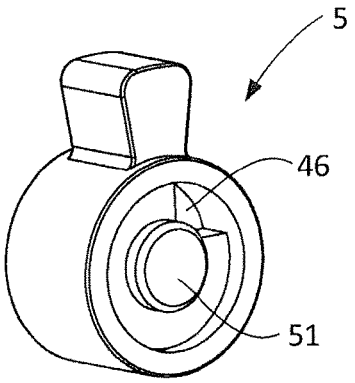
FIG. 5 is an isometric view of a preferred embodiment of a cam of the cylinder lock shown from a first side.
Figure 7:
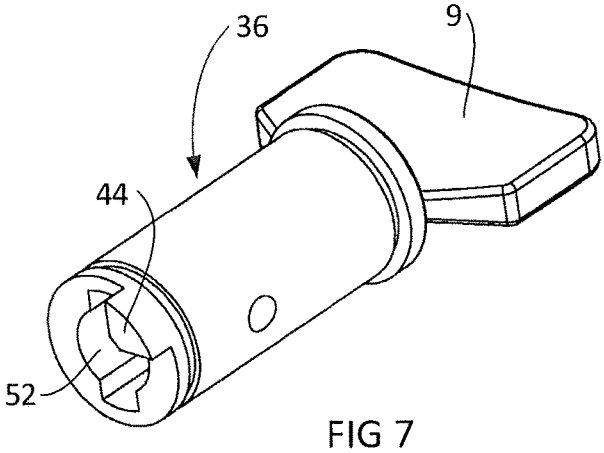
FIG. 7 is an isometric view of a preferred embodiment of a hand turn means from FIG. 4.
Figure 9:
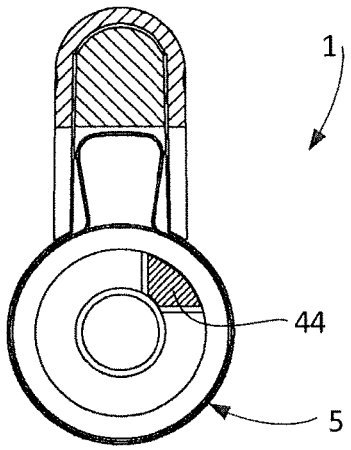
FIG. 9 is a cross sectional view through IX-IX from FIG. 1.

Referring now to FIGS. 7 and 5 which illustrate a preferred configuration for the distal end of the rotatable member 36 and a side (hereinafter the first side) of the cam 5. In this configuration, the protrusion 44 on the distal end of the rotatable member 36 is wedge shaped (see FIG. 9), and the first side of the cam 5 is formed with a wedge shaped recess 46. The wedge shaped recess 46 accommodates the wedge shaped protrusion 44. It can be appreciated particularly from FIG. 9 that rotation of the rotatable member 36 would result in direct rotation of the cam 5.

Figure 6:
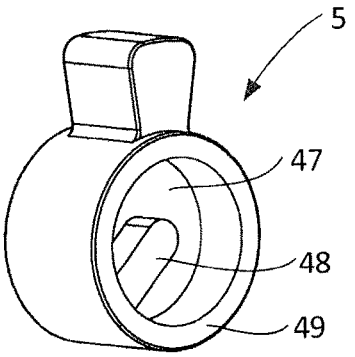
FIG. 6 is an isometric view of the cam from FIG. 5 shown from a second side.
Figure 8:
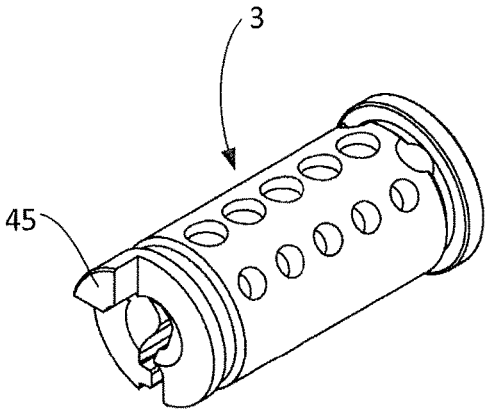
FIG. 8 is an isometric view of a preferred embodiment of a barrel from FIG. 4.

Referring now to FIGS. 8 and 6 which illustrate a preferred configuration of the distal end of the barrel 3 and a second side of the cam 5 so as to permit loss motion there between. The preferred configuration illustrated includes a wedge shaped protrusion 45 formed at the distal end of the barrel 3 which locates within an annular recess 47 formed in the second side of the cam 5. A radially extending wall 48 extends from the centre of the recess 47 out towards the peripheral annular wall 49 to define the recess 47. The shape of the projection 45, in combination with size of the radial wall, defines a limit within which loss motion of the barrel 3 relative to the cam 5. Accordingly, the shape of the protrusion 45 and the shape of the recess 47 may vary to achieve the same level of loss motion, or change the level of loss motion can occur. This loss motion is described in greater detail by reference to FIGS. 10 to 12.

Figure 10:
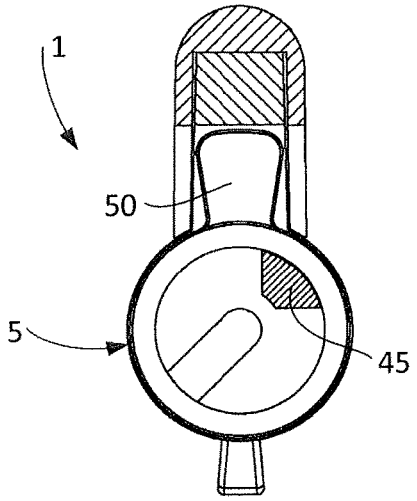
FIG. 10 is a cross sectional view through X-X from FIG. 1.

Referring firstly to FIG. 10 which illustrates the cylinder lock 1 in cross section from an outer perspective showing a cam arm 50 of the cam 5 in a vertical position (hereinafter referred to as the first position for the cam 5). The position of the protrusion 45 of the barrel 3 illustrated corresponds to the keyway 6 being in a vertical orientation (see for example FIG. 1). When the correctly cut key 7 is inserted into the keyway 6, it permits the barrel 3 to rotate relative to the outer cylindrical portion 17.

Figure 11:
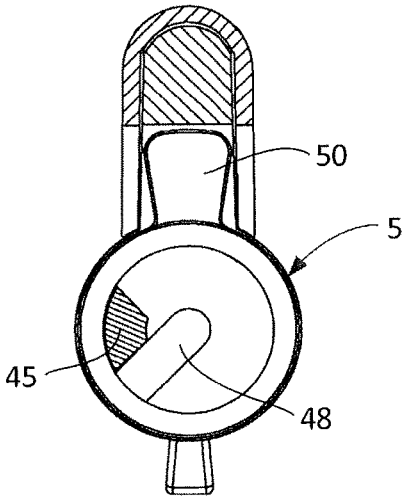
FIG. 11 is the cross sectional view from FIG. 10 with the barrel rotated through 135°, and the cam in the first position.
Figure 12:
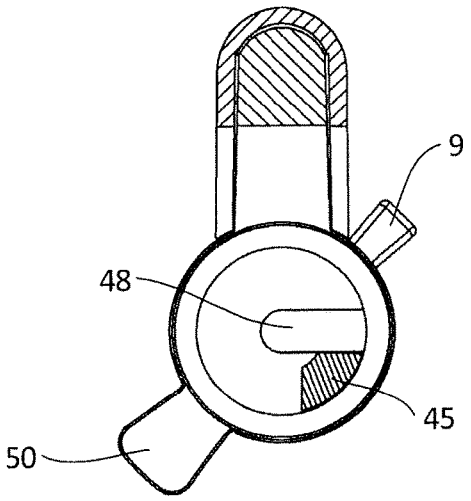
FIG. 12 is the cross sectional view from FIG. 10 with the barrel rotated through 270° and the cam rotated through 135°.

FIG. 11 illustrates movement of the protrusion 45 corresponding to anticlockwise rotation of the barrel 3 through 135° so that the wedge 45 is adjacent the radial arm 48. It should be noted from FIG. 11 that whilst the barrel 3 has been rotated, the cam 5 remains in the first position with the cam arm 50 being in the vertical orientation. Further rotation of the barrel 3 in the anticlockwise direction will result in rotation of the cam 5 from the first position. FIG. 12 illustrates the barrel having been rotated through a further 135° (total 270°) so as to cause the cam 5 to rotate through 135° from the first position. When the cylinder lock 1 is in use, this rotation of the cam 5 will permit it to interact with elements of, for example the detent 14, the mortice lock 10 as was described with reference to FIGS. 2 and 3.

In order that the key 7 can be removed from the keyway 6, the barrel must be capable of rotation so that the keyway 6 is again in the vertical orientation. It is preferred that the barrel be rotatable in the clockwise direction to return the keyway 6 to the vertical orientation so as to leave the cam arm 50 in the orientation illustrated in FIG. 12. It ought to be appreciated that clockwise rotation of the barrel back to aligning the keyway in the vertical orientation results in the protrusion 45 adopting the position illustrated in FIG. 10. This renders the cylinder lock 1 suitable for use in mortice lock assemblies 10 where the arm 50 of the cam 5 has limited space within which to rotate and yet still interact with the elements, such as the detent of the mortice lock.

It should also be appreciated that as the cam 5 is rotated by the hand turn means 4, the radial arm 48 will move while the protrusion 45 of the barrel 3 will remain stationary. If the key 7 is not in the keyway 6, the radial arm 48 will abut and be prevented from rotation beyond 135° by the protrusion 45.

The cylinder lock would fail to operate as intended (with loss motion and direct action), if the protrusion 44 of the rotatable member 36 was located within the recess 47 formed in the second side of the cam 5, and the protrusion 45 at the distal end of the barrel 3 was located within the recess 46 of the first side of the cam 5. Accordingly, it is preferred that the first side of the cam 5 be configured to inhibit mating for driving engagement with the barrel 3 when the cylinder lock is being assembled. This may be achieved in any suitable manner and in the embodiment illustrated in FIGS. 5, 7 and 8, it should be noted that the first side of the cam 5 is formed with a centrally located stem 51. The distal end of the rotatable member is formed with a centrally located aperture 52 which is configured to receive the stem 51 therein. However, the distal end of the barrel 3 does not include an equivalent aperture, and as such the stem 51 would prevent the protrusion 45 seating within the recess 46 formed in the first side of the cam 5. This in turn would prevent the annular groove 41 of the barrel 3 being accessible for fitting the circlip 43 when the barrel 3 is located in the outer cylindrical portion 17. This will reduce the likelihood of the cylinder lock 1 being assembled incorrectly.

It ought to be appreciated from the foregoing that the cylinder lock as hereinbefore described provides a relatively simple solution for adjusting between a left-hand operated and a right-hand operated mortice lock. Furthermore, the configuration of the first side of the cam 5 so as to inhibit the interaction with the barrel 3 provides a further useful result.

Various alterations and/or additions may be introduced into the cylinder lock as hereinbefore described without departing from the spirit or ambit of the invention.

The invention claimed is:

1. A cylinder lock for use with a lock assembly, the cylinder lock including a housing, a barrel includes a keyway for accommodating a key, the barrel being rotatable relative to the housing about an axis by rotation of said key inserted in the keyway, a hand turn means being rotatable about the axis relative to the housing, a cam including a body and an arm extending radially from the body for interaction with the lock assembly being rotatable relative to the housing about the axis from a first position by rotation of either the barrel or hand turn means, the cam being positioned between the barrel and the hand turn means, the barrel and the cam having portions thereof configured to mate for driving engagement while permitting loss motion there between, so that there is a lag between rotation of the barrel and rotation of the cam while the hand turn means and the cam having portions thereof configured to mate for driving engagement to act directly there between.

2. A cylinder lock according to claim 1 wherein the hand turn means and the barrel are rotatable to rotate the cam in both a clockwise direction and an anti-clockwise direction from the first position.

3. A cylinder lock according to claim 1 wherein the hand turn means can rotate the cam through no more than 135° from the first position.

4. A cylinder lock according to claim 3 wherein the hand turn means can rotate the cam through more than 135° when the key is inserted in the keyway, and is limited to rotating the cam through no more than 135° from the first position when the key is not inserted in the keyway.

5. A cylinder lock according to claim 1 wherein the hand turn means includes a rotatable member having a distal end and the cam body has a first side, both the distal end and the first side being configured to mate for driving engagement so that rotation of the rotatable member directly drives the cam.

6. A cylinder lock according to claim 5 wherein the distal end of the rotatable member includes a protrusion at its distal end and the first side of the cam body includes a recess to accommodate the protrusion.

7. A cylinder lock according to claim 6 wherein said protrusion is wedge shaped and said recess is similarly wedge shaped to receive the wedge shaped protrusion in a tight fit.

8. A cylinder lock according to claim 6 wherein the rotatable member includes a blade portion at a proximal end which is aligned with the cam arm when the cam is in the first position so as to permit the protrusion at the distal end of the rotatable member to locate in the recess of the first side of the cam body.

9. A cylinder lock according to claim 5 wherein the first side of the cam is configured to inhibit mating for driving engagement with the barrel when the cylinder lock is being assembled.

10. A cylinder lock according to claim 9 wherein said configuration of the first side includes a centrally located stem.

11. A cylinder lock according to claim 10 wherein the distal end of the rotatable member includes an aperture that is centrally located to accommodate the stem of the first side of the cam when the lock is assembled.

12. A cylinder lock according to claim 1 wherein the barrel has a distal end and the cam body has a second side, both the distal end of the barrel and the second side of the cam body being configured to mate for driving engagement there between while permitting loss motion of rotation between the barrel and the cam.

13. A cylinder lock according to claim 12 wherein the barrel and cam are configured for up to 135° of loss motion of rotation of the cam from the first position in either the clockwise direction or the anti-clockwise direction.

14. A cylinder lock according to claim 13 wherein the distal end of the barrel includes a protrusion and the second side of the cam body includes a recess to accommodate said protrusion, said recess and said protrusion being shaped to limit said loss motion of rotation.

15. A cylinder lock according to claim 14 wherein said recess on the second side is defined by a radially extending wall which is engaged by said protrusion on the barrel when the cam is rotated by the barrel.

16. A cylinder lock according to claim 15 wherein the protrusion of the barrel occupies an arc of no more than 30°.

17. A cylinder lock according to claim 1 wherein the housing includes a first bore to accommodate the barrel and a second bore to accommodate the hand turn means, the first bore being spaced from the second bore by a void to accommodate the cam.

18. A cylinder lock according to claim 17 wherein the housing includes a pin chamber portion having a plurality of tubes extending radially from the first bore and the second bore for accommodating pin tumblers.

19. A cylinder lock according to claim 18 wherein the tubes associated with the first bore accommodate pin tumblers and at least one of the tubes associated with the second bore accommodates a detent for interaction with the rotatable member.

20. A cylinder lock according to claim 2 wherein the hand turn means can rotate the cam through no more than 135° from the first position.

* * * * *